US007406287B2

(12) United States Patent
Matsumoto et al.

(10) Patent No.: US 7,406,287 B2
(45) Date of Patent: Jul. 29, 2008

(54) FIXING DEVICE AND IMAGE FORMING APPARATUS PROVIDED WITH FIXING DEVICE

(75) Inventors: Hiroyoshi Matsumoto, Ibaraki (JP); Toshio Ogiso, Ibaraki (JP); Shigeru Obata, Ibaraki (JP); Masahiro Yagi, Ibaraki (JP); Chikara Hiraoka, Ibaraki (JP); Chiharu Kamoshida, Ibaraki (JP)

(73) Assignee: Ricoh Printing Systems, Ltd., Tokyo (JP)

( * ) Notice: Subject to any disclaimer, the term of this patent is extended or adjusted under 35 U.S.C. 154(b) by 0 days.

(21) Appl. No.: 11/676,590

(22) Filed: Feb. 20, 2007

(65) Prior Publication Data

US 2007/0196145 A1 Aug. 23, 2007

(30) Foreign Application Priority Data

Feb. 20, 2006 (JP) ..... 2006-042604

(51) Int. Cl.
*G03G 15/20* (2006.01)

(52) U.S. Cl. ..... 399/328; 399/329; 219/216

(58) Field of Classification Search ..... 399/328, 399/329, 330, 343, 350; 219/216, 469–471
See application file for complete search history.

(56) References Cited

U.S. PATENT DOCUMENTS 5,999,788 A * 12/1999 Kanesawa et al. ..... 399/329
7,142,803 B2 * 11/2006 Koyama et al. ..... 399/329
2007/0048045 A1 3/2007 Yagi et al.

FOREIGN PATENT DOCUMENTS

| | | |
|---|---|---|
| JP | 8-262903 | 10/1996 |
| JP | 2007-072364 | 9/2005 |
| JP | 2007-178756 | 7/2007 |
| JP | 2007-187889 | 7/2007 |

* cited by examiner

*Primary Examiner*—Marvin Lateef
*Assistant Examiner*—G. M. Hyder
(74) *Attorney, Agent, or Firm*—Ladas & Parry LLP

(57) ABSTRACT

A disclosed fixing device includes: a heat roller unit having a rotatable roller having an elastic body on a surface thereof and a heating unit heating the roller; a pad disposed along a circumference of the elastic body of the heat roller; a belt member disposed on a curved surface of the pad, the belt member rotating by following a rotation of the heat roller; and a pressure member pressing the belt member to the heat roller using the pad, the fixing device causing a conveyed recording medium carrying a visualized image to pass through a space between the heat roller and the pressure member so as to fix the visualized image on the recording medium, wherein a curvature of the curved surface of the pad is changed in a central portion and end portions in an axial direction of the heat roller.

12 Claims, 5 Drawing Sheets

FIXING DEVICE AND IMAGE FORMING APPARATUS PROVIDED WITH FIXING DEVICE

BACKGROUND OF THE INVENTION

1. Field of the Invention

The present invention generally relates to a fixing device and an image forming apparatus provided with the fixing device and more particularly to a fixing device for improving fixation of a visualized image on a recording medium in a simple structure and an image forming apparatus provided with the fixing device.

2. Description of the Related Art

Conventionally, in the field of image forming apparatuses using electrophotography such as copier, printers, facsimile devices, and the like, there have been methods for improving the fixation of a visualized image of toner carried on a recording medium. General examples of such methods involve heat fixing methods in which toner images are fixed by heating a rotatable head fixing roller from the inside using a heater, the fixing roller elastically deforming a surface of the recording medium, and by pressing an endless belt capable of conveying while being in contact with the heat fixing roller from an opposite side relative to contact face using a pressure roller.

Regarding the above-mentioned heat fixing methods, there are nip fixing methods for pressing using a pressure pad made of rubber instead of the pressure roller pressing from the opposite side and conveying the recording medium using a belt rotating on a surface of the pressure pad so as to achieve a small size and improve efficiency (refer to Patent Document 1, for example). Further, it is known that when a pressure range of the pressure pad is increased, low-energy fixing is realized.

Patent Document 1: Japanese Laid-Open Patent Application No. 8-262903

However, when the pressure range of the pressure pad is increased, because of a load for pressing the pressure pad, plural pressure units such as springs are required as disclosed in Patent Document 1, so that the cost is increased. Further, in the fixing method as disclosed in Patent Document 1, when the springs are incorporated in a pressure applying unit including the pressure pad, a diameter of the endless belt is increased and an entire portion of the apparatus is enlarged.

SUMMARY OF THE INVENTION

It is a general object of the present invention to provide an improved and useful fixing device and image forming apparatus provided with the fixing device in which the above-mentioned problems are eliminated.

A more specific object of the present invention is to provide a fixing device and an image forming apparatus provided with the fixing device that can improve fixation of a visualized image on a recording medium in a simple structure.

According to one aspect of the present invention, there is provided a fixing device comprising: a heat roller unit having a rotatable roller having an elastic body on a surface thereof and a heating unit heating the roller; a pad disposed along a circumference of the elastic body of the heat roller; a belt member disposed on a curved surface of the pad, the belt member rotating by following a rotation of the heat roller; and a pressure member pressing the belt member to the heat roller using the pad, the fixing device causing a conveyed recording medium carrying a visualized image to pass through a space between the heat roller and the pressure member so as to fix the visualized image on the recording medium, wherein a curvature of the curved surface of the pad is changed in a central portion and end portions in an axial direction of the heat roller.

In accordance with this, it is possible to improve the fixation of the visualized image on the recording medium in a simple structure. Further, it is possible to reduce the number of parts and provide a small device.

According to another aspect of the present invention, the curvature of the curved surface of the pad is formed such that the curvature of the end portions of the pad is larger than the curvature of the heat roller which is larger than the curvature of the central portion of the pad.

In accordance with this, it is possible to obtain uniform nip widths formed using the heat roller unit and the pressure member and apply a sufficient load on the end portions of the recording medium such as paper. Thus, it is possible to prevent cold offset on the end portions of the recording medium.

According to another aspect of the present invention, the curvature of the curved surface of the pad is gradually changed from predetermined positions between the central portion of the pad and the end portions of the pad to the end portions of the pad.

In accordance with this, it is possible to obtain uniform nip widths formed using the heat roller unit and the pressure member and apply a sufficient load on the recording medium. Thus, it is possible to prevent cold offset on the end portions of the recording medium.

According to another aspect of the present invention, the above-mentioned fixing device includes: a pad fixing unit supporting and fixing the pad, wherein a contact face of the pad fixing unit in contact with the pad has an end portion supporting shape for gradually deforming the curved surface of the pad from predetermined positions to the end portions.

In accordance with this, it is possible to deform the curved surface of the pad using the end portion supporting shape of the pad fixing unit. Thus, it is possible to obtain uniform nip widths formed using the heat roller unit and the pressure member and apply a sufficient load on the recording medium.

According to another aspect of the present inventions there is provided a fixing device comprising: a heat roller unit having a rotatable roller having an elastic body on a surface thereof and a heating unit heating the roller; a pad disposed along a circumference of the elastic body of the heat roller; a belt member disposed on a curved surface of the pad, the belt member rotating by following a rotation of the heat roller; a pressure member pressing the belt member to the heat roller using the pad, the fixing device causing a conveyed recording medium carrying a visualized image to pass through a space between the heat roller and the pressure member so as to fix the visualized image on the recording medium; and a pad fixing unit supporting and fixing the pad, wherein a contact face of the pad fixing unit in contact with the pad has an end portion supporting shape for gradually deforming the curved surface of the pad from predetermined positions to end portions.

In accordance with this, it is possible to deform the curved surface of the pad using the end portion supporting shape of the pad fixing unit. Thus, it is possible to obtain uniform nip widths formed using the heat roller unit and the pressure member and apply a sufficient load on the recording medium. Further, by using the pad fixing unit, it is possible to deform the curved surface of the pad using a conventional pad having a constant curvature.

According to another aspect of the present invention, there is provided an image forming apparatus comprising any one of the above-mentioned fixing devices.

In accordance with this, it is possible to improve the fixation of the visualized image on the recording medium in a simple structure. Further, it is possible to reduce the number of parts and provide a small device.

According to the present invention, it is possible to improve the fixation of the visualized image on the recording medium in a simple structure.

Other objects, features and advantage of the present invention will become more apparent from the following detailed description when read in conjunction with the accompanying drawings.

DETAILED DESCRIPTION OF THE PREFERRED EMBODIMENTS

[Abstract of the Present Invention]

In the present invention, a shape of a pressure pad is changed. Specifically, the shape of the pressure pad is determined such that curvature is changed in a central portion and end portions. In this case, the curvature of the pressure pad is determined so as to satisfy a relationship "end portions of the pad>heat roller>central portion of the pad". Further, the curvature of the pad is constant until predetermined positions from the central portion of the pad to the end portions of the pad, and then the curvature is gradually changed from the predetermined positions to the end portions of the pad.

The following describes preferred embodiments of a fixing device and an image forming apparatus provided with the fixing device according to the present invention with reference to the drawings.

EXAMPLE 1

Figure 1:
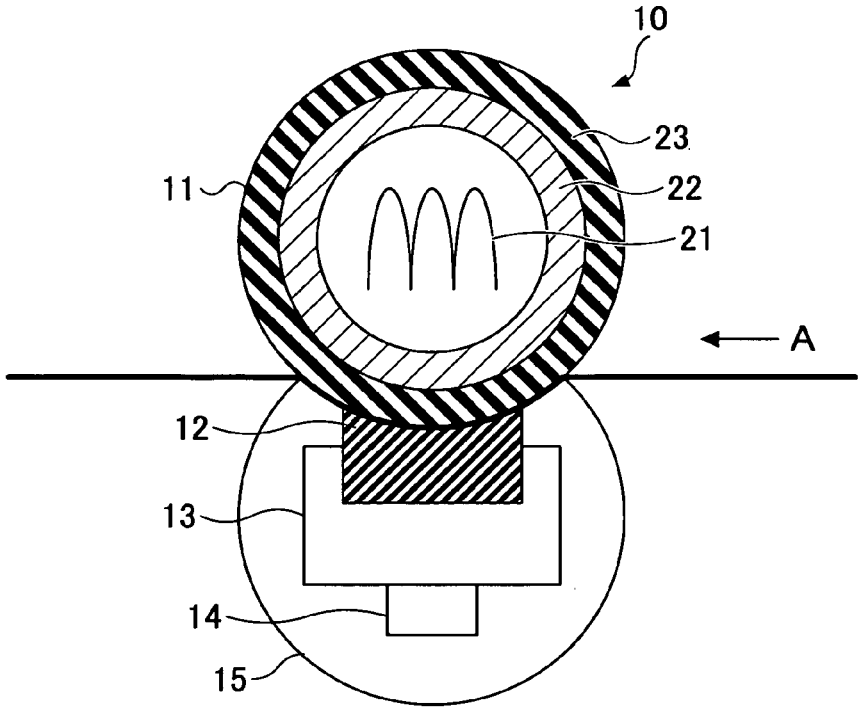
FIG. 1 is a side elevational view showing an example of a structure of a fixing device according to the present invention.
Figure 2:
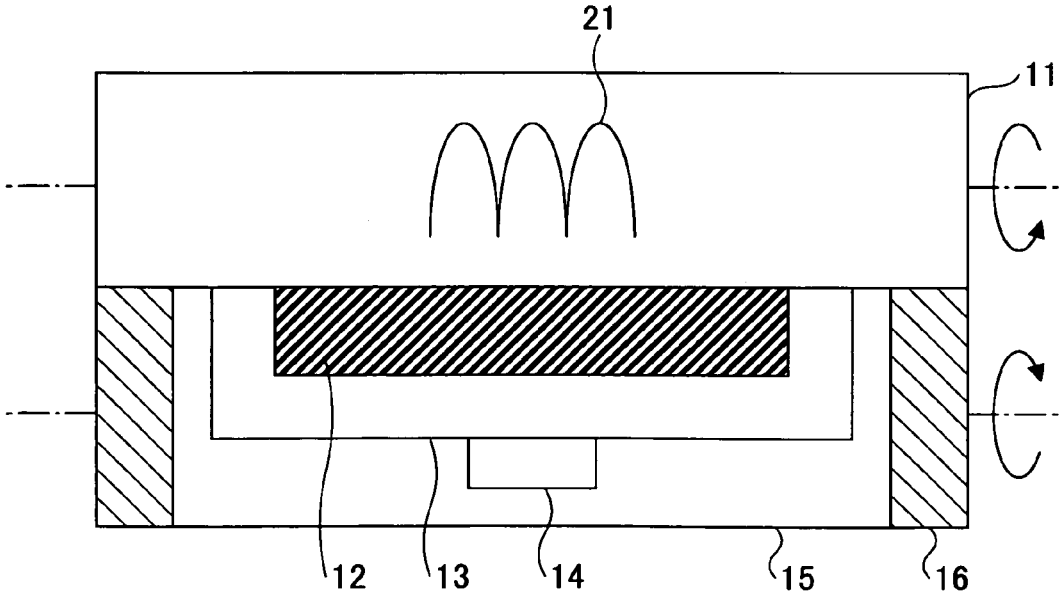
FIG. 2 is a diagram showing an example of a structure of a fixing device when viewed from an insertion direction of a recording medium.

FIG. 1 is a side elevational view showing an example of a structure of the fixing device according to the present invention. FIG. 2 is a diagram showing an example of the structure of the fixing device when viewed from an insertion direction (indicated by arrow A) of a recording medium. A fixing device 10 shown in FIGS. 1 and 2 includes a heat roller 11 as a heat fixing unit, a pressure pad 12, a holder 13 as a pad fixing unit fixing the pressure pad 12, a pressure member 14 pressurizing the holder 13 to the heat roller 11, and an endless belt member (endless belt) 15 rotating outside the pressure pad 12. As shown in FIG. 2, the fixing device 10 includes a support member 16 in a periphery of the holder 13, the support member 16 supporting the belt member 15 and the like.

Recording media such as paper are caused to pass through a nip portion of the fixing device 10 from the direction indicated by arrow A shown in FIG. 1 while a visualized image of a toner image, for example, is attached and unfixed.

A heater 21 is disposed inside the heat roller 11 as a heating unit. In addition, a metallic layer 22 made of iron, for example, is formed on a circumference of the heater 21 so as to improve heat propagation. An outside diameter in this status is 25 mm. Further, in the heat roller 11, an elastic body layer 23 with a thickness of 0.8 mm made of a silicon layer such as silicon rubber is formed on a circumference of a metallic cylinder.

The heat roller 11 has a driving source (not shown in the drawings) for rotation and the belt member 15 rotates by following the rotation of the heat roller 11. The heater 21 inside the heat roller 11 is set to have a predetermined temperature and heats a recording medium conveyed between the heat roller 11 and the belt member 15.

The holder 13 has a shape for holding and fixing the pressure pad 12. Although a concave portion is formed as the shape of the holder 13 in FIGS. 1 and 2, the present invention is not limited to this shape. Any type of shape may be used as long as the shape corresponds to a shape of the pressure pad 12 and is capable of holding, fixing, or locking the pressure pad 12. The pressure pad 12 may be bonded and fixed on the holder 13 using a bond, for example.

A contact face of the pressure pad 12 in contact with the belt member 15 has a predetermined curved shape along a circumference face of the elastic body layer 23 of the heat roller 11 so as to increase an area of the contact face between the heat roller 11 and the belt member 15. In the contact face between the pressure pad 12 and the belt member 15, a low-friction member may be disposed on the pressure pad 12 so as to improve lubricity. Further, lubricant may be coated onto the contact face on the belt member 15 in contact with the pressure pad 12. Moreover, the above-mentioned low-friction member and lubricant may be applied to both of the pressure pad 12 and the belt member 15 so as to realize low friction.

The pressure member 14 facing the heat roller 11 via the belt member 15 includes a pressure mechanism such as a spring. In the present invention, the pressure pad 12 and the holder 13 are fixed at one central point in an axial direction so as to reduce the number of parts. In spite of the structure where the pressure pad 12 and the holder 13 are fixed at the central point in the axial direction, it is possible to constantly bring the pressure pad 12 into areal contact with the heat roller 11.

A load to press the pressure pad 12 on the heat roller 11 is adjusted by the pressure member 14 such that the load on a surface is 40 kgf/mm$^2$ so as to be in contact with the heat roller 11 and cause the belt member 15 to follow movement of the heat roller 11 and to apply a sufficient pressure on a recording medium.

[Shape of the Pressure Pad 12]

Next, a shape of the pressure pad 12 is described including the details to achieve the shape in the present invention. As mentioned above, the surface of the pressure pad 12 is provided with the curved shape and the pressure member 14 is disposed so as to press the pressure pad 12 such that a center of the load is positioned at the center of the pad in the axial direction. When the pressure pad 12 is actually installed on an image forming apparatus, a toner image is coated onto paper as a visualized image, and printing is attempted, a preferable image is formed at a central portion of the paper. However, what is called toner offset is generated from an end portions to inner sides about 10 mm therefrom in the paper where the toner image is insufficiently fixed and is readily scraped off. An investigation of the toner offset has revealed that the central portion and the end portions of the paper have different nip widths.

Thus, in the present invention, the surface shape of the pressure pad 12 is changed. Specifically, the curvature of the surface of the pressure pad 12 is changed in the central portion and the end portions relative to the axial direction of the heat roller 11.

Figure 3A:
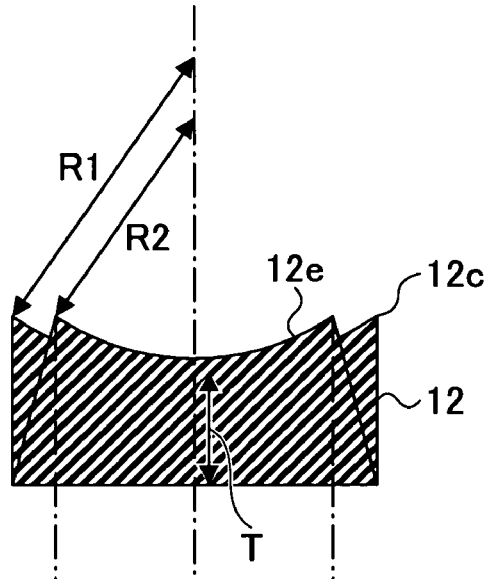
FIG. 3A is a cross-sectional view of a pressure pad in example 1.
Figure 3B:
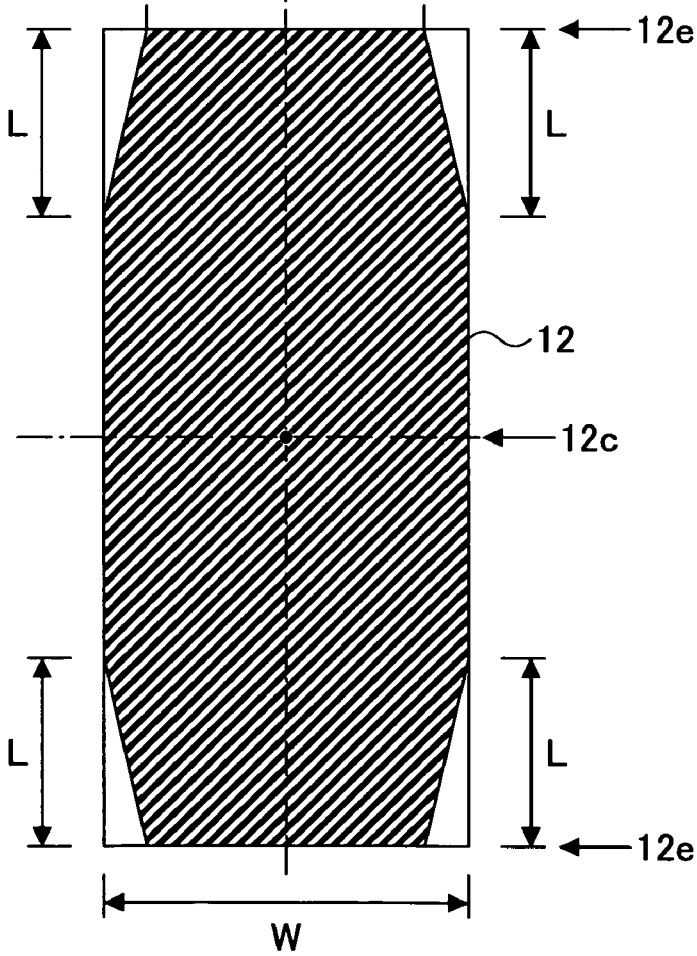
FIG. 3B is a diagram showing a contact face of a pressure pad in example 1.

In the following, the shape of the pressure pad 12 in the present invention is described with reference to the drawings. FIGS. 3A and 3B are diagrams showing an example of a specific shape of the pressure pad in example 1. FIG. 3A is a cross-sectional view of the pressure pad 12. FIG. 3B is a diagram showing the contact face on the pressure pad 12 in contact with the belt member 15.

The pressure pad 12 is configured to have a rubber hardness of 30 degrees (ASKER C), a width (W) of 12 mm, and a thickness (T) of 4 mm at a least thick portion. When the curvature of the pressure pad 12 is the same as that of the heat roller 11, it is impossible to obtain nip widths required for fixing, so that such a curvature is undesirable in terms of power saving since an output of the heater 21 must be increased.

In view of this, a new pressure pad 12 is prepared in which the curvature is increased. As a result, nip widths required for fixing are obtained. However, when a toner image is actually coated onto a recording medium and printing is performed, what is called cold offset is generated from inner sides about 20 mm from both end portions to both ends in a printed material where toner is output while insufficiently fixed due to a low fixing temperature.

An investigation of the cold offset has revealed that upon pressing using the pressure mechanism, the pressure pad 12 and the holder 13 are fixed at the central point, so that the pressure pad 12 is formed such that the center of the pressure pad 12 with a high curvature is pressed on the heat roller 11 and wraps the heat roller 11. As a result, although a nip width sufficient for fixing is obtained in the central portion, the end portions in the axial direction of the pressure pad 12 fail to receive a sufficient pressure and nip widths are decreased, so that the cold offset is generated.

Thus, in the present invention, the curvature of the pressure pad 12 is set so as to satisfy a relationship "end portions of the pressure pad>heat roller>central portion of the pressure pad". Specifically, in accordance with the above-mentioned example, a diameter of the heat roller 11 is 25 mm+(0.8×2) mm=26.6 mm and a radius is 13.3 mm. Accordingly, when a radius (R1) of the central portion (12*c* in FIGS. 3A and 3B) of the pressure pad 12 is larger than a radius of the heat roller 11, it is possible to wrap the heat roller 11.

However, when the radius is excessively large, an entire portion of the curved surface of the pressure pad 12 presses a surface of the heat roller 11, so that a load on the pressure member 14 is increased. In view of this, the radius of the pressure pad 12 is set to about 15.3 mm which is larger than the radius of the heat roller 11 by about 2 mm, for example. Although the central portion (12*c*) of the pressure pad 12 according to the present invention is not limited to this, the central portion of the pressure pad 12 is preferably set to about 13.3 mm to 15.3 mm, for example.

When the radius of the both end portions (12*e*) of the pressure pad 12 is smaller then that of the heat roller 11, it is possible to press the surface of the heat roller 11 in a uniform manner without generating insufficient portions, so that the radius of both end on the portions of the pressure pad 12 is sent to 12.5 mm based on the radius of 13.3 mm of the heat roller 11, for example. Although both end portions (12*e*) of the pressure pad 12 in the present invention are not limited to this, both end portions of the pressure pad 12 are preferably set in a range from 13.3 mm to 12.3 mm.

In other words, as mentioned above, the relationship of the curvature between the pressure pad 12 and the heat roller 11 is set to as to satisfy the relationship "end portions of the pressure pad>heat roller>central portion of the pressure pad". Further, the change of the curvature from the central portion 12*c* to both end portions 12*e* in the pressure pad 12 is preferably set such that the curvature is gradually changed from predetermined positions on both ends to the end portions. In other words, the change of the curvature is constant until the predetermined positions from the central portion of the pad to the end portions of the pad, then the curvature is gradually changed from the predetermined positions to the end portions of the pad.

In FIG. 3B, a distance L from the end portions is set to 20 mm and the curvature is linearly changed in proportion to the distance from the end portions. However, the present invention is not limited to this, and the curvature may be changed in a curved shape in accordance with the distance from the end portions or the curvature may be gradually changed in each of predetermined distances, for example.

In this manner, by gradually changing the curvature of the central portion and the curvature of the end portions, sufficient nip widths are formed in the vicinity of both ends of the pressure pad, so that it is possible to realize a preferable image forming without cold offset on both end portions of a recording medium.

[Shape of the Holder 13]

When the above-mentioned pressure pad 12 is used, the holder 13 has a concave shape as mentioned above, for example, and the pressure pad 12 is pressed or bonded to the concave portion.

In the present invention, the surface shape of the above-mentioned pressure pad 12 is formed on the holder 13 and a pressure pad of an elastic body such as rubber having a certain curvature on a surface thereof is fitted in the holder 13 having the surface shape, so that the pressure pad is pressed from a backside thereof in accordance with the surface shape of the holder 13. Thus, it is possible to form the surface of the pressure pad 12 using different curvatures in the central portion and both end portions. In the following, the above-mentioned description is illustrated as example 2 with reference to the drawings.

EXAMPLE 2

Figure 4A:
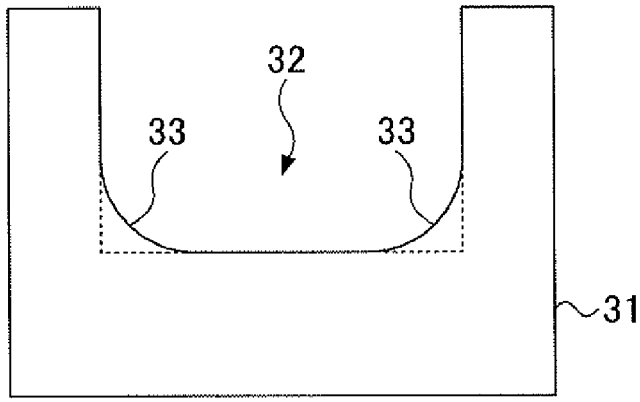
FIG. 4A is a side elevational view showing a holder in example 2.
Figure 4B:
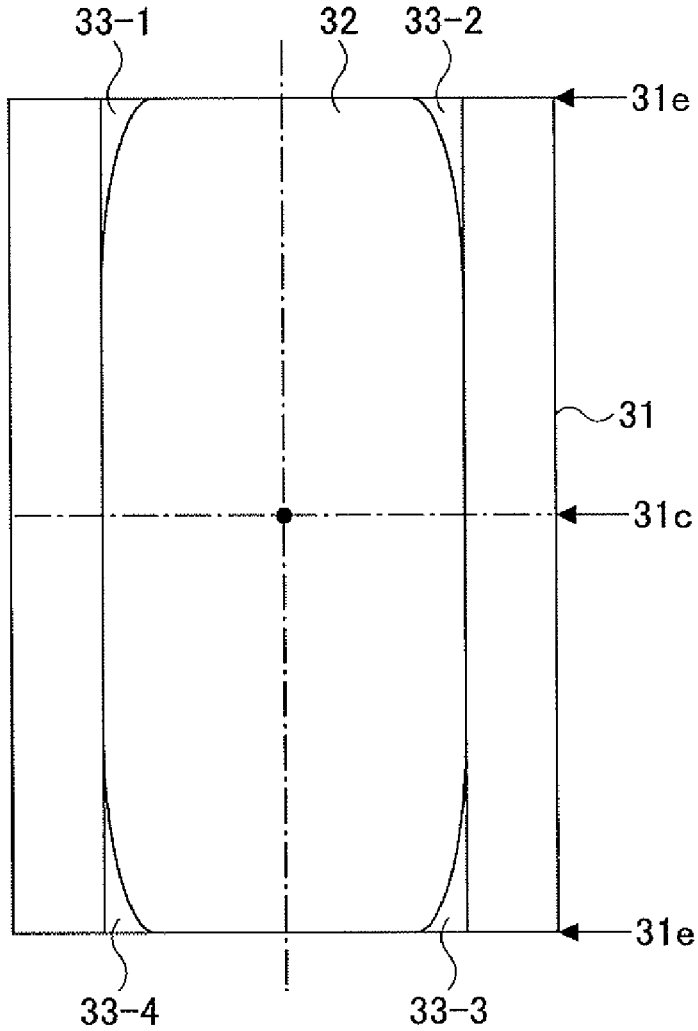
FIG. 4B is a top view showing a holder in example 2.
Figure 5:
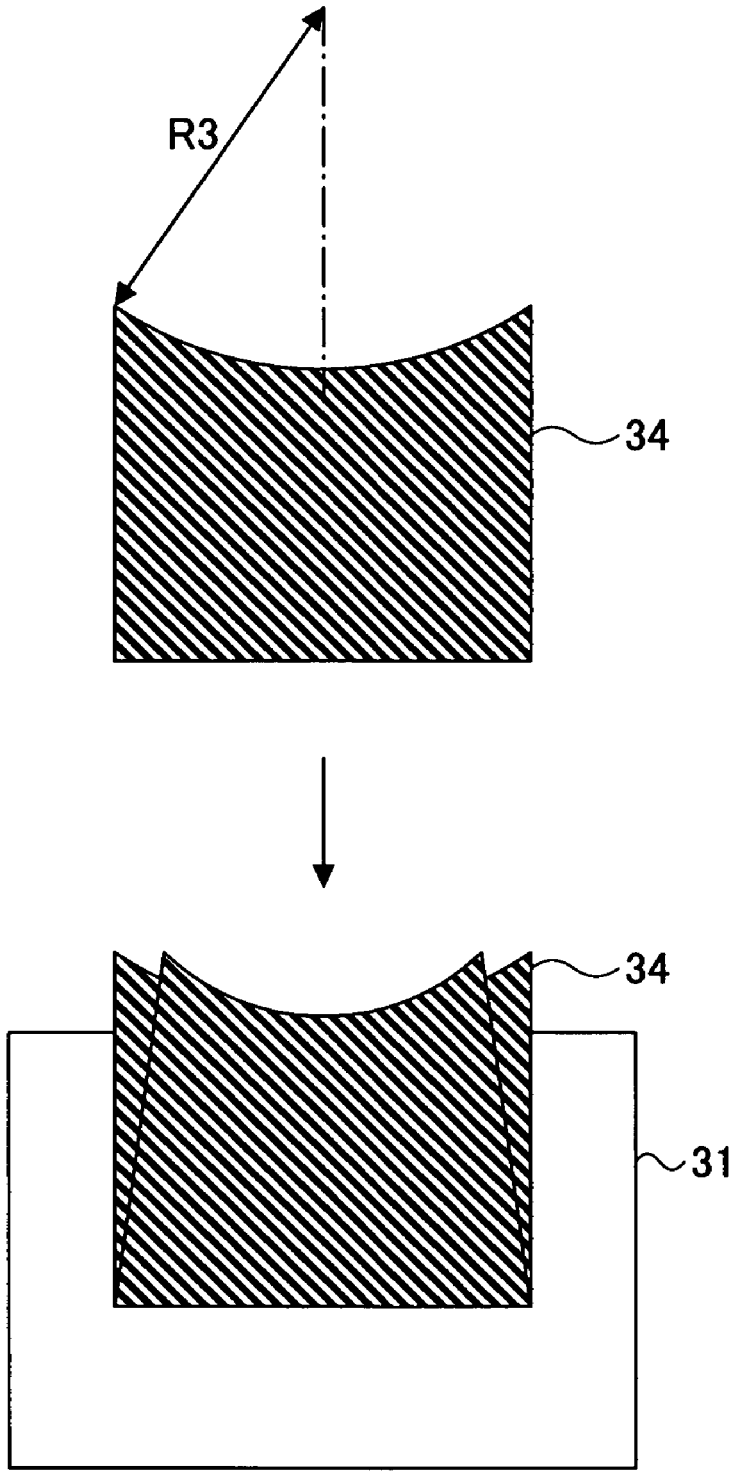
FIG. 5 is a diagram showing the holder of FIGS. 4A and 4B when a pressure pad is fitted therein.

FIGS. 4A and 4B are diagrams illustrating a shape of the holder in example 2. FIG. 5 is a diagram showing the holder of FIGS. 4A and 43 when the pressure pad is fitted therein. FIG. 4A is a side elevational view showing a holder 31 and FIG. 4B is a top (surface) view showing the holder 31. In the present example, the curvature of the curved surface of a pressure pad 34 may be constant. Accordingly, the as shown in FIG. 5, the curvature (radius) R3 of the surface of the pressure pad 34 is constant. In the present example, the radius R3 is set to be larger than the radius of the heat roller 11 (about 15.3 mm, for example).

As shown in FIGS. 4A and 4B, the holder 31 in example 2 has a concave portion 32 and a shape of corners of the central portion (31*c*) of the holder 31 is the same as an installation surface of the pressure pad 34 in the holder 31. In other words, the central portion 31*c* of the holder does not apply pressure that deforms the pressure pad 34.

Both end portions 31*e* of the holder have end portion supporting shapes 33-1 to 33-4 for pressing the pressure pad 34 such that the curvature (radius) of the contact face (surface of the pressure pad) between the pressure pad 34 and the belt member 15 is different in both end portions and the central portion.

The end portion supporting shapes 33-1 to 33-4 are formed such that the curvature of the end portions of the pressure pad 34 is gradually changed from predetermined positions at both end portions. The end portion supporting shapes 33-1 to 33-4 may be changed in a curved shape in accordance with the distance from the end portions or in each of predetermined distances such that the curvature is gradually changed.

In this case, the curvature in the pressure pad 34 and the heat roller 11 is set so as to satisfy the relationship "end portions of the pressure pad>heat roller>central portion of the pressure pad". Thus, by inserting the pressure pad 34 into the concave portion of the holder 31 according to the present invention, in the vicinity of the end portions of the pressure pad 34, the pressure pad 34 is pressed by the end portion supporting shapes 33-1 to 33-4 from beneath. Accordingly, as shown in FIG. 5, it is possible to deform the surface shape of the pressure pad 34.

In this manner, by gradually changing the curvature of the central portion and the curvature of the end portions from predetermined positions, sufficient nip widths are formed in the vicinity of both ends of the pressure pad, so that it is possible to realize a preferable recording medium (printed material) without cold offset on both end portions of the recording medium.

The method for changing the curvature of the pressure pad according to the present invention is not limited to the above-mentioned examples 1 and 2. Examples 1 and 2 may be combined so as to form an appropriate curvature, for example.

[Image Forming Apparatus]

When the above-mentioned fixing device 10 is applied to image forming apparatuses using electrophotography such as copiers, printers, facsimile devices, and the like, it is possible to fix a visualized image such as a toner image on a recording medium promptly and accurately in a simple structure.

Figure 6:
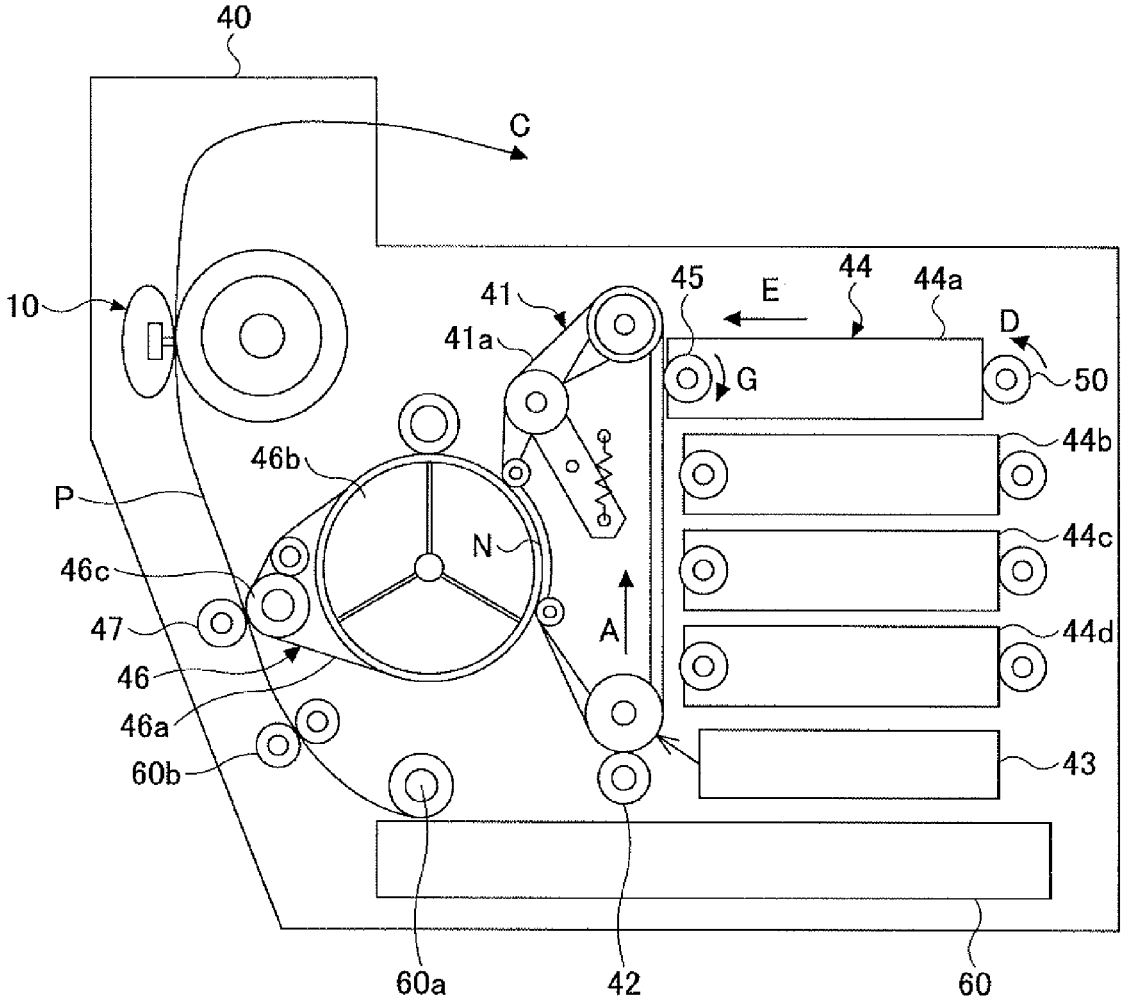
FIG. 6 is a side elevational view showing an image forming apparatus using an example of a fixing device according to the present invention.

In the following, the image forming apparatus to which the fixing device 10 according to the present invention is applied is described with reference to the drawings. FIG. 6 is a side elevational view showing the image forming apparatus using an example of the fixing device according to the present invention. As shown in FIG. 6, an image forming apparatus 40 is a color laser printer as an example capable of forming color images in which an intermediate transfer body 46 is rotated four times and four color images are superposed.

The image forming apparatus 40 includes the fixing device 10 according to the present invention, a photoconductor belt unit 41, a charging brush 42, an optical device 43, a development device 44, the intermediate transfer body 46, a transfer roller 47, a retract unit 50, and a paper cassette 60.

When an image is formed in the image forming apparatus 40, first, a photosensitive layer of a photoconductor belt 41*a* is charged using the charging brush 42, a laser beam is irradiated onto the photosensitive layer of the photoconductor belt 41*a* from the optical device 43 in accordance with the image and electric potential is removed. Then, while a development roller 45 to which toner of the development units 44*a* to 44*d* is attached is rotated in a direction indicated by arrow G shown in FIG. 6, the development roller 45 is brought into contact with the photoconductor belt 41*a* and a toner layer is formed on the photoconductor belt 41*a* in accordance with the image.

The photoconductor belt unit 41 has the photoconductor belt 41*a* in which a toner image is formed from the development device 44. The photoconductor belt 41*a* is conveyed in a direction indicated by arrow A shown in FIG. 6. Further, an intermediate transfer belt 46*a* is conveyed by following a convey force of a nip portion N in contact with the photoconductor belt 41*a*.

The development device 44 includes the development units 44*a* to 44*d* of four colors, namely, black, yellow, magenta, and cyan. The development units 44*a* to 44*d* store toner of each color and include the development rollers 45 disposed on end portions thereof facing the photoconductor belt 41*a*, the development rollers 45 forming a thin film of toner.

When the toner image is formed on the photoconductor belt 41*a*, the retract unit 50 is rotated in a direction indicated by arrow D shown in FIG. 6 so as to move the development units 44*a* to 44*d* in a direction indicated by arrow E shown in FIG. 6 and the development rollers 45 are brought into contact with the photoconductor belt 41*a*.

The intermediate transfer body 46 includes the intermediate transfer belt 46*a* for transferring the toner image formed on the photoconductor belt 41*a*. The intermediate transfer belt 46*a* is wrapped around a photoconductor side roller 46*b* and a transfer side roller 46*c*.

The transfer roller 47 presses a recording medium P conveyed from the paper cassette 60 on the intermediate transfer belt 46*a* using a retract unit not shown in the drawings and transfers the toner image on the intermediate transfer belt 46*a* to the recording medium P.

In the image forming apparatus 40, a paper conveying path C, the intermediate transfer body 46, the photoconductor belt unit 41, and the development device 44 are sequentially arranged in a horizontal direction relative to an installation surface of the apparatus. Further, on the paper conveying path C, the paper cassette 60, a pickup roller 60*a*, a register roller 60*b*, the transfer roller 47, and the fixing device 10 are arranged.

The recording medium P in which the unfixed toner image is formed while passing through a space between the transfer roller 47 and the intermediate transfer body 46 is heated and pressurized in a process of passing through the fixing device 10 according to the present invention, so that the unfixed toner image is fixed.

In this manner, by disposing the fixing device 10 according on the present invention to the image forming apparatus, it is possible to fix the toner image on the recording medium promptly and accurately in a simple structure.

As mentioned above, according to the present invention, it is possible to improve the fixation of a visualized image on a recording medium in a simple structure. Specifically, when the present invention is applied, nip widths formed using the heat roller and the pressure member are uniformly obtained, so that it is possible to apply a sufficient load on end portions of the recording medium. Thus, it is possible to prevent cold offset on the end portions of the recording medium.

Moreover, according to the present invention, it is possible to reduce the number of parts, realize a fixing device in a simple structure, and provide a smaller device.

In addition, it is possible to apply the fixing device and the image forming apparatus provided with the fixing device according to the present invention to the field of printers using electrophotography for printing at a high speed and electrostatic recording apparatuses such as copiers, for example.

The present invention is not limited to the specifically disclosed embodiment, and variations and modifications may be made without departing from the scope of the present invention.

The present application is based on Japanese priority application No. 2006-042604 filed Feb. 20, 2006, the entire contents of which are hereby incorporated herein by reference.

What is claimed is:

1. A fixing device comprising:

a heat roller unit having a rotatable roller having an elastic body on a surface thereof and a heating unit heating the roller;

a pad disposed along a circumference of the elastic body of the heat roller;

a belt member disposed on a curved surface of the pad, the belt member rotating by following a rotation of the heat roller; and a pressure member pressing the belt member to the heat roller using the pad, the fixing device causing a conveyed recording medium carrying a visualized image to pass through a space between the heat roller and the pressure member so as to fix the visualized image on the recording medium, wherein a curvature of the curved surface of the pad is changed in a central portion and end portions in an axial direction of the heat roller.

2. The fixing device according to claim 1, wherein the curvature of the curved surface of the pad is formed such that the curvature of the end portions of the pad is larger than the curvature of the heat roller which is larger than the curvature of the central portion of the pad.

3. The fixing device according to claim 1, wherein the curvature of the curved surface of the pad is gradually changed from predetermined positions between the central portion of the pad and the end portions of the pad to the end portions of the pad.

4. The fixing device according to claim 2, wherein the curvature of the curved surface of the pad is gradually changed from predetermined positions between the central portion of the pad and the end portions of the pad to the end portions of the pad.

5. The fixing device according to claim 1, including:

a pad fixing unit supporting and fixing the pad, wherein a contact face of the pad fixing unit in contact with the pad has an end portion supporting shape for gradually deforming the curved surface of the pad from predetermined positions to the end portions.

6. A fixing device comprising:

a heat roller unit having a rotatable roller having an elastic body on a surface thereof and a heating unit heating the roller;

a pad disposed along a circumference of the elastic body of the heat roller;

a belt member disposed on a curved surface of the pad, the belt member rotating by following a rotation of the heat roller;

a pressure member pressing the belt member to the heat roller using the pad, the fixing device causing a conveyed recording medium carrying a visualized image to pass through a space between the heat roller and the pressure member so as to fix the visualized image on the recording medium; and a pad fixing unit supporting and fixing the pad, wherein a contact face of the pad fixing unit in contact with the pad has an end portion supporting shape for gradually deforming the curved surface of the pad from predetermined positions to end portions.

7. An image forming apparatus comprising:

a fixing device including:

a heat roller unit having a rotatable roller having an elastic body on a surface thereof and a heating unit heating the roller;

a pad disposed along a circumference of the elastic body of the heat roller;

a belt member disposed on a curved surface of the pad, the belt member rotating by following a rotation of the heat roller; and a pressure member pressing the belt member to the heat roller using the pad, the fixing device causing a conveyed recording medium carrying a visualized image to pass through a space between the heat roller and the pressure member so as to fix the visualized image on the recording medium, wherein a curvature of the curved surface of the pad is changed in a central portion and end portions in an axial direction of the heat roller.

8. The image forming apparatus according to claim 7, wherein the curvature of the curved surface of the pad is formed such that the curvature of the end portions of the pad is larger than the curvature of the heat roller which is larger than the curvature of the central portion of the pad.

9. The image forming apparatus according to claim 7, wherein the curvature of the curved surface of the pad is gradually changed from predetermined positions between the central portion of the pad and the end portions of the pad to the end portions of the pad.

10. The image forming apparatus according to claim 8, wherein the curvature of the curved surface of the pad is gradually changed from predetermined positions between the central portion of the pad and the end portions of the pad to the end portions of the pad.

11. The image forming apparatus according to claim 7, including:

a pad fixing unit supporting and fixing the pad, wherein a contact face of the pad fixing unit in contact with the pad has an end portion supporting shape for gradually deforming the curved surface of the pad from predetermined positions to the end portions.

12. An image forming apparatus comprising:

a fixing device including:

a heat roller unit having a rotatable roller having an elastic body on a surface thereof and a heating unit heating the roller;

a pad disposed along a circumference of the elastic body of the heat roller;

a belt member disposed on a curved surface of the pad, the belt member rotating by following a rotation of the heat roller;

a pressure member pressing the belt member to the heat roller using the pad, the fixing device causing a conveyed recording medium carrying a visualized image to pass through a space between the heat roller and the pressure member so as to fix the visualized image on the recording medium; and a pad fixing unit supporting and fixing the pad, wherein a contact face of the pad fixing unit in contact with the pad has an end portion supporting shape for gradually deforming the curved surface of the pad from predetermined positions to end portions.

* * * * *